United States Patent [19]

Torii

[11] 4,408,458

[45] Oct. 11, 1983

[54] ELECTRIC POWER GENERATING SYSTEM

[75] Inventor: Akiomi Torii, Yokohama, Japan

[73] Assignee: Tokyo Shibaura Denki Kabushiki Kaisha, Kanagawa, Japan

[21] Appl. No.: 283,619

[22] Filed: Jul. 15, 1981

[30] Foreign Application Priority Data

Jul. 29, 1980 [JP] Japan ..... 55-104083

[51] Int. Cl.[3] ..... F01K 13/02

[52] U.S. Cl. ..... 60/660; 60/652

[58] Field of Search ..... 290/52; 60/652, 660, 60/664, 665, 667

[56] References Cited

U.S. PATENT DOCUMENTS 4,118,935 10/1978 Andersson ..... 60/652

4,120,159 10/1978 Matsumoto ..... 60/667

4,357,803 11/1982 Dickenson ..... 60/667 X

*Primary Examiner*—Allen M. Ostrager

*Attorney, Agent, or Firm*—Stevens, Davis, Miller & Mosher

[57] ABSTRACT

An electric power generating system capable of absorbing a variable load comprises a boiler, and steam turbines, which are interconnected through a steam conduit including a control valve which adjusts the flow amount of the steam, an electric generator driven by the turbines, and a variable pressure operation control device. The control device maintains a constant degree of opening of the control valve at a time when a steam pressure in the steam conduit lies in a range between predetermined pressure values. The control device comprises an element for comparing an actual steam pressure in the steam conduit and a steam pressure predeterminable in accordance with load variation thereby to generate a signal to determine a variable pressure operation characteristic line. Thus, the degree of opening of the control valve can be changed in response to the compared pressure differences.

3 Claims, 17 Drawing Figures

ELECTRIC POWER GENERATING SYSTEM

BACKGROUND OF THE INVENTION

This invention relates to an electric power generating system capable of absorbing a variable load in response to which the output of a turbine of the generating system can be varied.

Generally, in factories, many kinds of loads are connected to the electric power generating system and the loads vary at a regular or irregular period. For example, in steel manufacturing factories, a finish hot rolling mill, a preliminary hot rolling mill, a cold rolling mill, and a seamless pipe rolling mill constitute variable loads which vary periodically and first and second blooming mills constitute variable loads which vary irregularly. In a steel manufacturing factory the sum of these loads is considered as a periodically variable load. The electric power generating system to which such loads are connected as variable loads must be operated so as to promptly follow up change in the load. This means that the electric power generating system has to be provided with some means for absorbing the variation in the load, particularly in a case where a large load is connected to a generating system which has a considerably small generating capacity such as in a steel manufacturing factory.

Various methods for absorbing a variation in the load have been well known in which the output of a steam turbine is varied and these methods include methods in which steam accumulators or turbine by-pass valves are used or the amount of condensation of the steam exhausted from the turbine is adjusted.

These and other methods or devices of known type for absorbing a load variation accompany various problems as will be hereinafter described in detail.

SUMMARY OF THE INVENTION

It is an object of this invention to provide an improved electric power generating system capable of quickly following up a load variation.

Another object of this invention is to provide an electric power generating system including variable load absorption means comprising a variable pressure characteristic line transferring device for changing a pressure on a boiler side in response to the load variation.

According to this invention, there is provided an electric power generating system capable of absorbing a variable load of the type comprising a boiler, a steam turbine, an electric generator driven by the turbine, the boiler and the steam turbine being interconnected through a steam conduit including a control valve which adjusts the steam flow amount in the steam conduit, and a variable pressure operation control device which maintains a constant degree of opening of the control valve at a time when a steam pressure in the steam conduit lies in a range between predetermined pressure values, and in such generating system, the variable pressure operation control device comprises an element for comparing an actual steam pressure in the steam conduit with a pressure predetermined in accordance with variation of a load of the generator for generating a signal to determine a variable pressure operation characteristic line for changing the degree of the control valve in response to a difference between the compared pressures.

DESCRIPTION OF THE PREFERRED EMBODIMENT

As conducive to a full understanding of the exact nature of this invention, general aspect of a variable load absorbing generating system and various problems encountered in known systems of this type will first be considered in conjunction with FIG. 1*a* through FIG. 4.

Figure 1A:
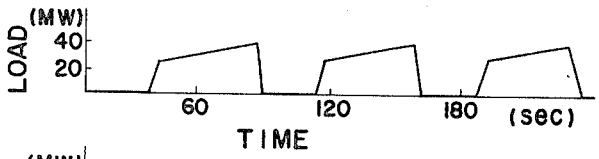
FIG. 1a PRIOR ART
FIG. 1*a* through FIG. 1*g* are graphs showing types of variable loads to be connected to a general power generating system.
Figure 1B:
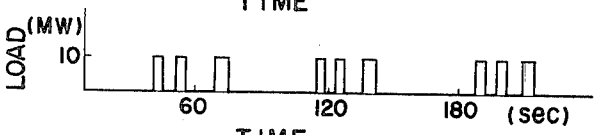
FIG. 1b PRIOR ART
Figure 1C:
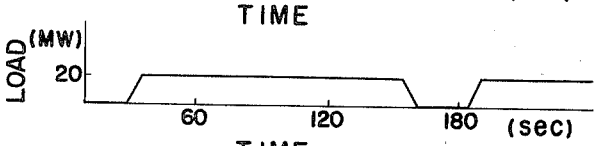
FIG. 1c PRIOR ART
Figure 1D:
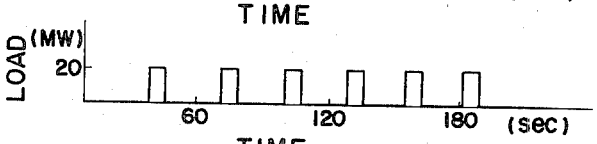
FIG. 1d PRIOR ART
Figure 1E:
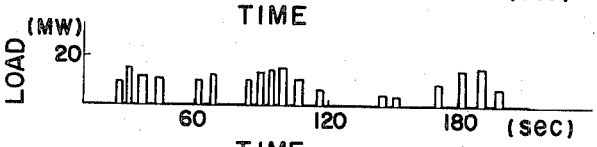
FIG. 1e PRIOR ART
Figure 1F:
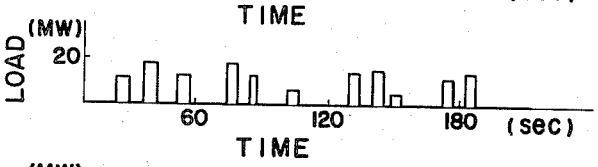
FIG. 1f PRIOR ART
Figure 1G:
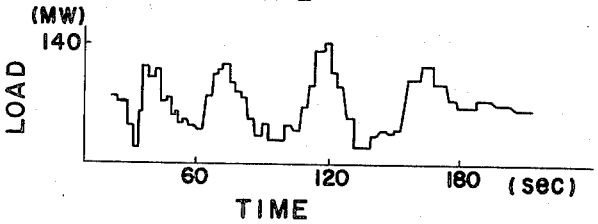
FIG. 1g PRIOR ART
Figure 2:
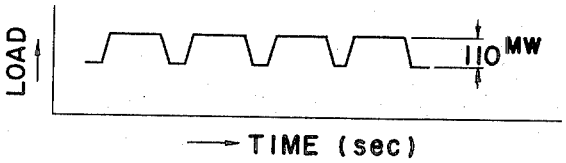
FIG. 2 PRIOR ART
FIG. 2 is a graph showing an example of a periodically variable load.

FIGS. 1*a* through 1*g* show types of variable loads to be connected to an electric power generating system installed in a steel manufacturing factory, in which FIGS. 1*a* through 1*d* show respectively, as periodically variable loads, the loads of finishing hot rolling mill, preliminary hot rolling mill, cold rolling mill, and seamless pipe rolling mill, and FIGS. 1*e* and 1*f* represent respectively, as irregularly variable loads, the loads of first and second blooming mills. FIG. 1*g* represents a sum of these loads shown in FIGS. 1*a* through 1*f* which is deemed to vary in substantially a periodical interval and the sum of the loads shown in FIG. 1*g* may ideally be modified as represented by FIG. 2.

Figure 3:
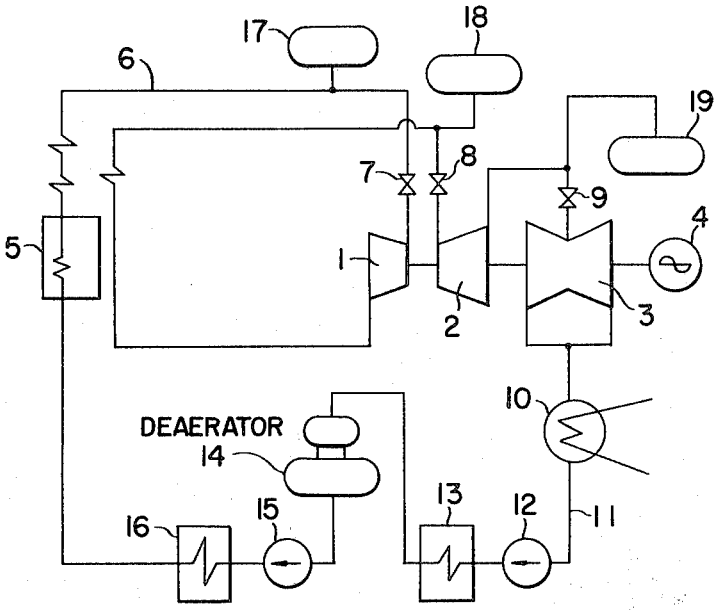
FIG. 3 PRIOR ART
FIG. 3 is a schematic diagram showing a conventional electric power generating system capable of absorbing variation of load by using accumulators.

FIG. 3 shows a diagrammatic view of a known type electric power generating system for following up load variation by using steam accumulators. In this generating system, high, medium, and low pressure turbines 1, 2, and 3 are supplied with steam from a boiler 5 for driving an electric generator 4. The steam from the boiler 5 flows in succession through a steam conduit 6, a steam control valve 7, a high pressure turbine 1, an intercept valve 8, a medium pressure turbine 2, a low pressure inlet valve 9, and a low pressure turbine 3, thus operating the turbines 1, 2, and 3. The steam discharged from the low pressure turbine 3 is condensed in a condenser 10 and the condensed water therefrom is returned to the boiler 5 through a condensation conduit 11, a condensate pump 12, a low pressure heater 13, an deaerator 14, a boiler feed pump 15, and a high pressure heater 16.

With this known generating system, in order to vary the output of each pressure turbine in response to the variation of a load, not shown, connected to the generator 4, a main steam line accumulator 17, a reheat steam line accumulator 18, and a low pressure line accumulator 19 for accumulating steam under respective pressures are arranged, respectively, on the upstream sides of the steam control valve 7, the intercept valve 8, and the low pressure inlet valve 9. The opening degrees of these valves can be adjusted in accordance with the variation of the load, whereby the outputs of the respective turbines 1, 2, and 3 can be controlled by causing the respective accumulators to temporarily store excessive amount of steam or supply stored steam to turbines.

With the generating system of this type, although it is not necessary to reconstruct the main constituent components of the generating system including the turbines 1, 2, and 3 and the boiler 5, it is required to additionally locate large accumulators, which enlarges the scale of whole system, thus increasing the construction cost.

Figure 4:
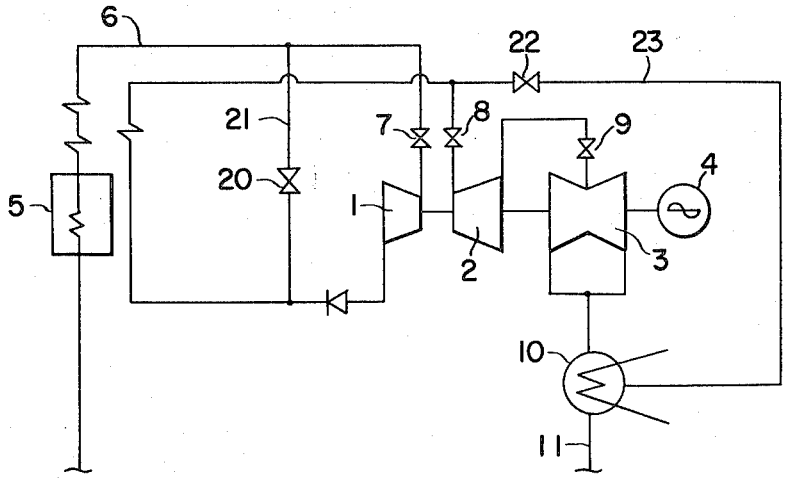
FIG. 4 PRIOR ART
FIG. 4 is a schematic diagram showing a conventional electric power generating system capable of absorbing variation of load by using turbine by-pass valves.

FIG. 4 also shows another example of a known type electric power generating system in which turbine by-pass valves are provided. In FIG. 4, a steam conduit on the upstream side of the steam control valve 7 and a steam conduit on the downstream side of the high pressure turbine 1 are short-circuited through a by-pass conduit 21 including a by-pass valve 20 for the high pressure turbine 1, and a steam conduit of the upstream side of the intercept valve 8 and the condenser 10 are short-circuited through a by-pass conduit 23 including a high pressure by-pass valve 20 for the low pressure turbine 3. The boiler 5 of this generating system is normally operated to produce an amount of steam corresponding to the maximum load, and during this operation, the excessive steam due to decrease of load is by-passed through the respective conduits 21 and 23 by adjusting the opening degrees of the by-pass valves 20 and 22.

With the generating system of this type, however, it is obliged to utilize the by-pass valves 20 and 22having high reliability and durability, and moreover, by-passing of steam lowers thermal efficiency.

There has also been proposed a method in which the outputs of the turbines are increased by stopping or decreasing the condensed water flow to reduce steam extraction amount to the low pressure heater 13.

With this method, however, the ratio of the output increase of the turbine is only 6–7% of the output obtainable at a time of the normal operation of the condenser 10, and in addition, since more than 30 seconds are spent as a response time for increasing the output, thus making it impossible to rapidly increase the output to follow up a load variation which occurs periodically in a short time.

Even when the systems or the methods described above are combined, problems encountered hereinbefore could not be solved.

Furthermore, there has been proposed, as an effective counterplan for a variable load, a power generating method in which in order to sufficiently utilize energy accumulated in a drum type boiler, anticipated control method is applied to get quick response, in addition to heavy oil support combustion, to the variation of a load of a coal burning boiler. In this method, a load limiter is used to limit the output of a turbo-generator so that an overload may not disturb the operation of the boiler. However, this method also includes such defects as that the power generating system is enlarged and complicated.

Ideally, it would be desirable to take a balance between the output of the boiler and the electrical load in response to quickly varying boiler output thereby to operate the generator with a constant frequency. In presently used boilers, however, there is a time lag between the fuel supply amount variation and the actual variation in the output of the boiler, for example, about 2 minutes in a through flow type boiler and 5 minutes in a drum type boiler. Such response time is too late to quickly respond to the rapid variation of such a load as shown in FIGS. 1*a* through 1*g*.

The present invention has proposed to solve the above described problems encountered in the known electric power generating systems or methods and will be described in detail hereunder in conjunction with FIG. 5 through FIG. 8*b*.

Figure 5:
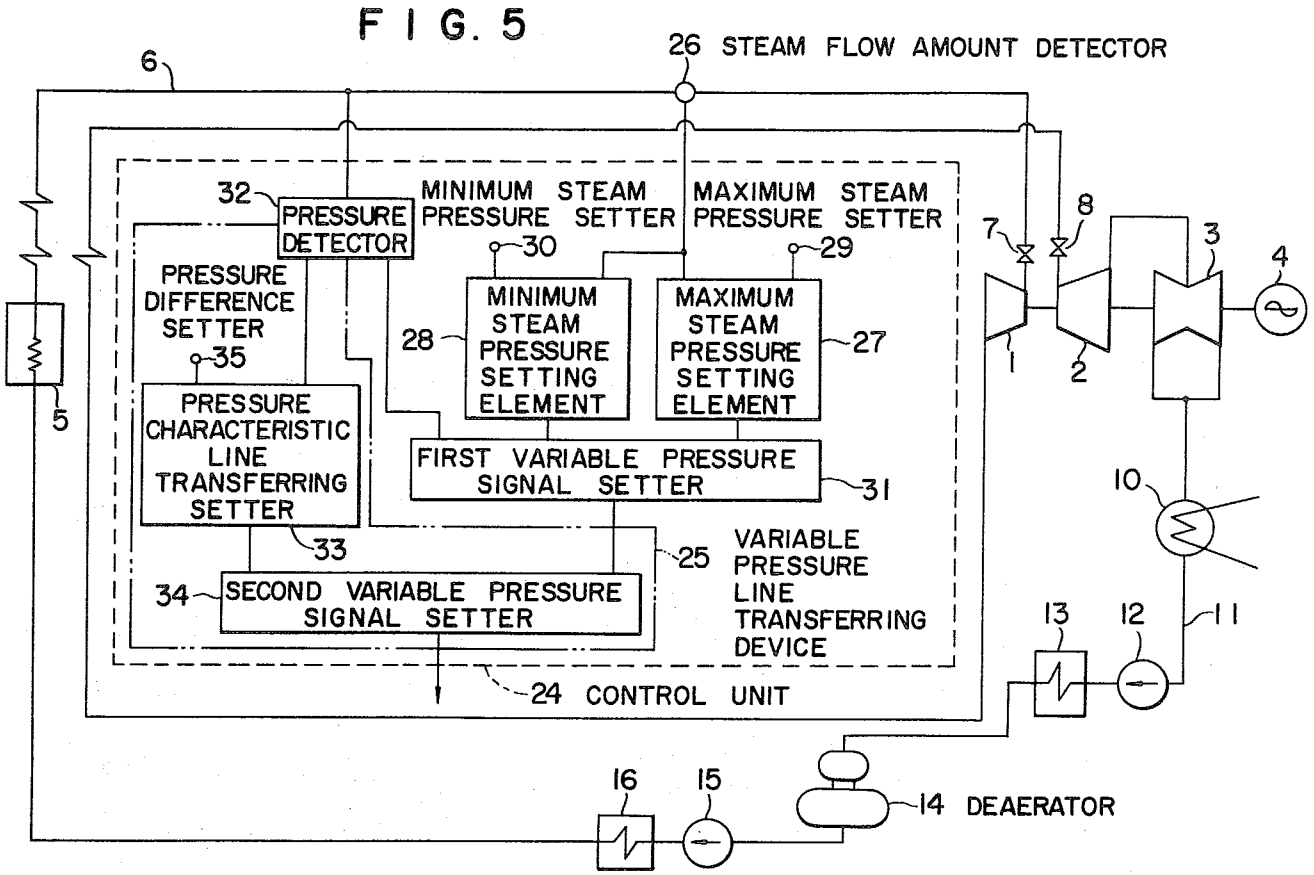
FIG. 5 is a schematic diagram showing an electric power generating system capable of absorbing variation of load according to this invention.
Figure 6A:
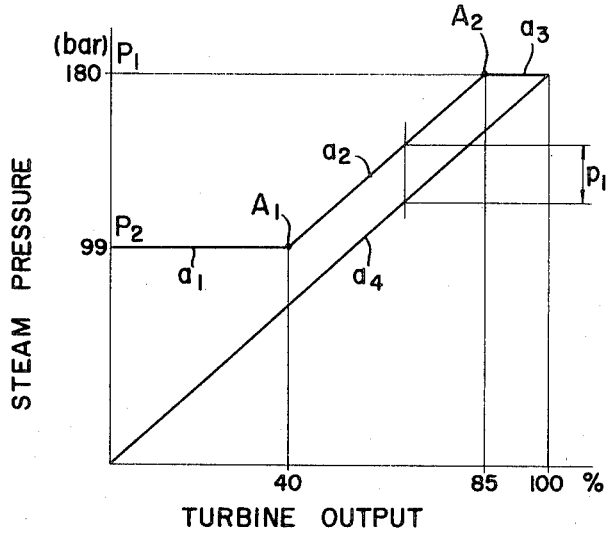
FIG. 6*a* is a graph showing relationship between outputs of turbines and steam pressure.

Referring to FIG. 5 in which like reference numerals are added to elements corresponding to those shown in FIG. 3 or 4, a device 24, enclosed by dotted lines, for controlling a boiler 5 operating under a variable pressure is disposed for the steam conduit 6 at a point upstream the steam control valve 7. The control device 24 comprises known type operating devices 27 through 31 for operating the boiler on the basis of, for example, the pressure characteristics shown in FIG. 6*a* and a variable pressure line transferring device 25, enclosed by dot and dash lines in FIG. 5, for changing the pressure on the boiler side in accordance with a load variation amount. A steam flow amount detector 26 is connected in the steam conduit 6 upstream the steam control valve 7 for detecting the steam flow amount in the conduit 6. A maximum pressure setting element 27 and a minimum pressure setting element 28 are connected in parallel with the steam flow amount detector 26 and these pressure setting elements are also connected to a first variable pressure signal setter 31. A maximum pressure setter 29 for setting a maximum steam pressure, for example, $P_1$ shown in FIG. 6*a*, is connected to the maximum pressure setting element 27, which operates to apply an operation signal to the first variable pressure signal setter 31 at a time when a signal representing the steam flow amount through the detector 26 reaches the maximum value preset in the maximum steam pressure setter 29. On the other hand, a minimum steam pressure setter 30 for setting a minimum steam pressure, for example $P_2$ in FIG. 6*a*, is connected to the minimum pressure setting element 28, which operates to apply an operation signal to the first variable pressure signal setter 31 at a time when a signal representing the steam flow amount through the detector 26 reaches the minimum value preset in the minimum steam pressure setter 30.

A pressure detector 32 is connected to an intermediate point of the steam conduit 6 upstream the steam flow amount detector 26. The first variable pressure signal setter 31 and a pressure characteristic line transferring setter 33 for generating a signal representing a pressure characteristic line are connected in parallel with the pressure detector 32. These setters 31 and 33 are also connected to a second variable pressure signal setter 34 which transfers a variable pressure characteristic line. The first variable pressure signal setter 31 sends a signal to the second variable pressure signal setter 34 for maintaining the constant degree of opening of the steam control valve, i.e. the lift thereof, as shown by the line $b_2$ in FIG. 6*b* when a value represented by a signal generated from the pressure detector 32 resides between values represented by signals from the pressure setting elements 27 and 28 (at this time, the boiler 5 operates at a variable pressure). On the other hand, when a value represented by a signal from the pressure detector 32 is out of a range between values represented by signals from the pressure setting elements 27 and 28, the first variable pressure signal setter 31 sends a signal to the second variable pressure signal setter 34 so as to increase the lift of the steam control valve 7 as shown by the lines $b_1$ and $b_3$ in FIG. 6*b* in accordance with the increase of the output.

A pressure difference setter 35 is connected to the pressure line transferring setter 33 for transmitting thereto a signal representing a pressure which is suitably set in response to the variation of the load. The pressure signal from the setter 35 is made to coincide with the period of the load variation in a case where the load periodically varies and a preliminarily varied pressure signal can be stored in the pressure difference setter 35. On the other hand, the load varies randomly, the pressure difference setter 35 may be cooperated with a senser, not shown, which detects the load variation, thereby to generate a signal regarding a suitably predetermined pressure from the pressure difference setter 35. The pressure line transferring setter 33 compares a signal sent from the pressure detector 32 regarding an actual steam pressure in the steam conduit 6 with a signal regarding the suitably predetermined pressure from the pressure difference setter 35 for sending a signal to the second variable pressure signal setter 34 for changing thedegree ofopening of the steam control valve 7, i.e. the lift thereof, in accordance with the pressure difference. The second variable pressure signal setter 34 sends a signal to the steam control valve 7 so as to close or open it in accordance with the signals from the first variable pressure signal setter 31 and the pressure line transferring setter 33.

The electric power generating operation of the generating system of this invention will be described hereunder.

Figure 6B:
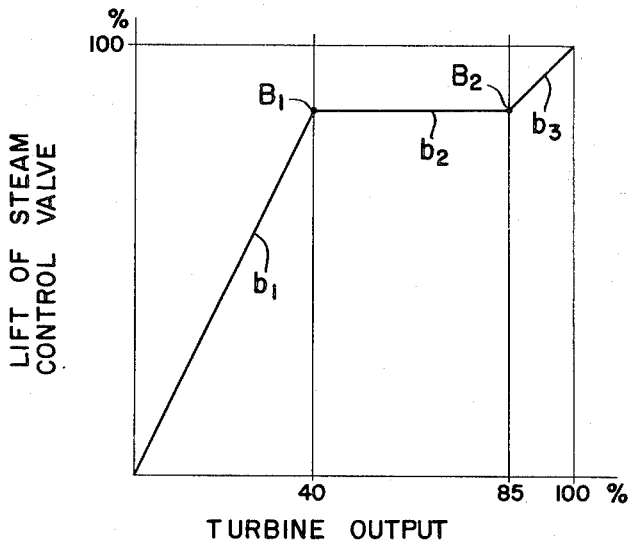
FIG. 6*b* is a graph showing relationship between outputs of turbines and valve stroke of a steam control valve.

The boiler 5 operates to feed steam to the respective turbines 1, 2 and 3 such that the steam pressure in the steam conduit 6 is maintained at a value $P_2$ as shown by the line $a_1$ in FIG. 6*a* until the output of each turbine reaches approximately 40% of its rated value, and at this time, the lift of the steam control valve 7 is increased gradually as shown by the line $b_1$ in FIG. 6*b*. When the steam flow amount reaches a value corresponding to approximately 40% of the rated pressure value in the conduit 6, the minimum pressure setting element 28 operates to send a signal to the variable pressure signal setter 31. At this time, another signal indicating the fact that the steam pressure reaches 40% of its rated value is also sent to the first variable pressure signal setter 31 from the pressure detector 32. The first variable pressure signal setter 31 then applies a signal to the steam control valve 7 through the second variable pressure signal setter 34 for stopping the increase of the valve stroke of the control valve 7 to maintain the degree of opening thereof at a constant value. This operation is changed at points $A_1$ shown in FIG. 6*a* and $B_1$ in FIG. 6*b*.

The degree of opening of the steam control valve 7 is maintained at a constant value as represented by the line $b_2$ in FIG. 6*b* until the output of the turbine reaches approximately presetted value of 85% of its rated output value, and in this time, the boiler 5 is operated under a variable pressure as shown by the line $a_2$ in FIG. 6*a*. The pressure represented by the line $a_2$ is preset to a pressure higher, by a pressure $P_1$, than that in a pure variable pressure operation mode shown by the line $a_4$ in FIG. 6*a*.

When the turbine output reaches 85% of its rated value, which is represented by the points $A_2$ in FIG. 6*a* and $B_2$ in FIG. 6*b*, the maximum pressure setting element 27 operates along the characteristic lines $a_3$ in FIG. 6*a* and $b_3$ in FIG. 6*b*.

Figure 7A:
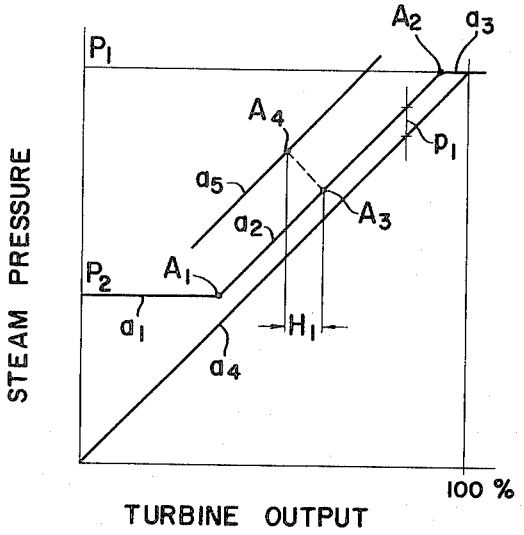
FIGS. 7*a* and 7*b* show graphs corresponding to FIGS. 6*a* and 6*b*, respectively, in a case where the load decreases.

FIGS. 7*a*, 7*b* and 8*a*, 8*b* represent operating characteristics of the turbines at a time when the boiler operates in a normal manner under a variable pressure, and in these figures, reference letters mean the same contents as those shown in FIGS. 6*a* and 6*b*. FIG. 7*a* shows a case where the load decreases at the point $A_3$ on the line $a_2$ during the operation of the boiler under a variable pressure.

Figure 7B:
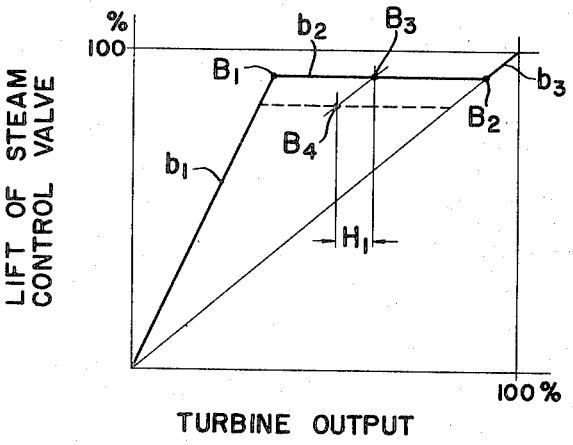

Supposing that the decrease of the load is caused by a periodically varying load, a signal representing the suitable steam pressure, which decreases synchronously with the decrease of the load, would be sent from the pressure difference setter 35 to the pressure characteristic line transferring setter 33. The setter 33 compares this pressure signal with a signal representing an actual steam pressure from the pressure detector 32 and generates a signal corresponding to the difference between the compared signals. The signal from the pressure line transferring setter 33 is then sent to the steam control valve 7 through the second variable pressure signal setter 34 for reducing the valve stroke of the steam control valve 7. Upon receiving this signal, the valve stroke is reduced as shown in FIG. 7*b* from the point $B_3$ to the point $B_4$, thereby to reduce the degree of opening of the steam control valve. The reduction of the valve opening increases the steam pressure in the steam conduit 6 from the point $A_3$ to the point $A_4$ as shown in FIG. 7*a*, thus smoothly reducing the output of the turbine by $H_1$ as shown in FIGS. 7*a* and 7*b*. Thereafter, when the load becomes constant, the boiler operates along the operation mode line $a_5$ in FIG. 7*a*.

Figure 8A:
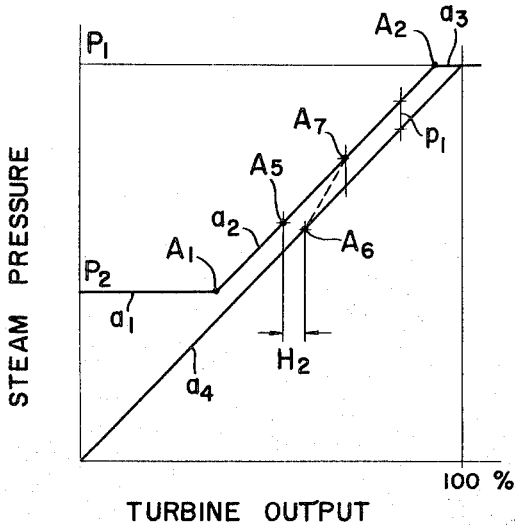
FIGS. 8*a* and 8*b* show graphs corresponding to FIGS. 6*a* and 6*b*, respectively, in a case where the load increases.
Figure 8B:
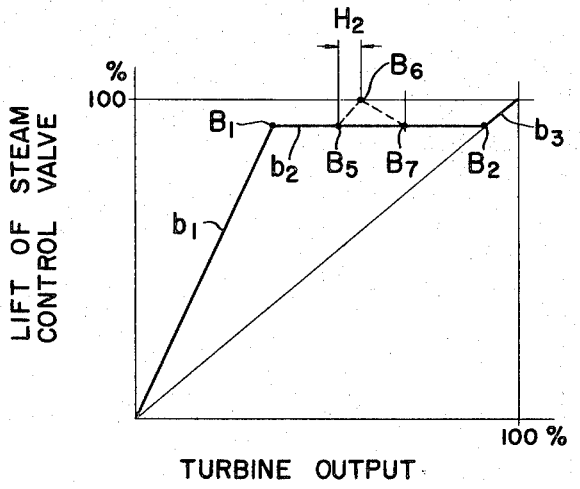

FIGS. 8*a* and 8*b* show a case in which the load is rapidly increased at the point $A_5$ on the line $a_2$ during the operation of the boiler under a variable pressure.

When the load again rises, the pressure line transferring setter 33 again compares signals representing the preset pressure and the actual steam pressure to apply a signal to the steam control valve 7 through the second variable pressure signal setter 34 for increasing the valve stroke of the valve 7 in accordance with the difference between the compared values. The valve stroke of the steam control valve 7 then quickly increases from the point $B_5$ to the point $B_6$ (fully opened state) as shown in FIG. 8*b*. At this time, the steam pressure decreases from the point $A_5$ to the point $A_6$ in FIG. 8*a* and the turbine output increases by $H_2$ as shown in FIGS. 8*a* and 8*b*. Thus, the output can be smoothly and quickly increased by the amount corresponding to the increase of the load. Thereafter, the steam pressure returns to that represented by the line $a_2$ showing the normal operation mode shown by the line $a_4$ in FIG. 8*a*, and according to this pressure return, the valve stroke of the control valve 7 also returns, as shown in FIG. 8*b*, to the point $B_7$ from the point $B_6$. According to this function, the load smoothly increases and finally reaches to the required output.

The variable load absorption device according to this invention is applicable to an electric power generating system using a through flow type boiler and a drum type boiler. The control of the feed water amount and drain pressure of the boiler feed pump 15 for changing a variable pressure operation mode may be applied for the operation of this invention. At that time, an extraction valve, not shown, which bleeds the steam from the high pressure turbine 1 to the high pressure heater 16 can be effectively throttled in combination with the variable pressure absorption means of this invention for appropriately responding to the load variation. Namely, in this control, mere increase of the feed water amount of the boiler feed pump 15 increases the amount of the steam extracted and supplied to the high pressure heater 16, which results in the lowering of the output of the turbines, and therefore, it becomes necessary to throttle the steam extraction valve which controls the steam to be extracted from the high pressure turbine and supplied to the high pressure heater in order to prevent the lowering of the turbine output caused by the lowerings of the load and the steam pressure.

According to the electric power generating system including a variable load absorption device of this invention, the output of the turbines can be controlled by changing a steam pressure so as to respond to the load variation under a variable pressure operation of a boiler, so that the output of the turbine can be sufficiently quickly changed in response to a rapidly varying load. Moreover, it should be noted that the electric power generating system described above can be constructed by merely incorporating a variable pressure characteristic line transferring device into a known type generating system.

What is claimed is:

1. In an electric power generating system capable of absorbing a variable load of the type comprising a boiler, a steam turbine, an electric generator driven by said turbine, said boiler and said turbine being interconnected through a steam conduit including a control valve which adjusts the flow amount of the steam in said steam conduit, and a variable pressure operation control device which maintains a constant degree of opening of said control valve at a time when a steam pressure in said steam conduit lies in a range between predetermined pressure values, the improvement in which said variable pressure operation control device comprises means for comparing an actual steam pressure in said steam conduit with a pressure predetermined in accordance with variation of a load of said generator for generating a signal to determine a variable pressure operation characteristic line for changing the degree of opening of said control valve in response to a difference between said compared pressures.

2. The electric power generating system according to claim 1 wherein said means is a variable pressure characteristic line transferring device which comprises a pressure difference value setter for generating a signal representing a pressure which is predetermined in response to the variation of the load and a pressure characteristic line transferring setter for generating a signal representing a difference value obtained by comparing a signal regarding the actual steam pressure in said steam conduit with a signal regarding said predetermined pressure.

3. The electric power generating system according to claim 2 wherein said pressure difference value setter generates a signal representing a steam pressure variable in synchronism with the variation of the load which varies periodically.

* * * * *